US005180085A

United States Patent [19]

Schmid

[11] Patent Number: 5,180,085

[45] Date of Patent: Jan. 19, 1993

[54] MANUALLY OPERATED AEROSOL SPRAYER

[76] Inventor: Hans G. Schmid, 26 Locust La., Huntington, N.Y. 11743

[21] Appl. No.: 743,924

[22] Filed: Aug. 9, 1991

[51] Int. Cl.[5] ..... B67D 1/04

[52] U.S. Cl. ..... 222/211; 222/401; 222/386.5

[58] Field of Search ..... 222/207, 209, 211, 212, 222/214, 401, 410.18, 135, 387, 386.5, 394, 399; 239/327, 321

[56] References Cited

U.S. PATENT DOCUMENTS

| | | | |
|---|---|---|---|
| 3,860,150 | 1/1975 | Maier | 222/207 X |
| 3,992,003 | 11/1976 | Visceglia | 222/386.5 X |
| 3,995,779 | 12/1976 | Mizzi | 222/401 |
| 4,098,434 | 7/1978 | Uhlig | 222/209 X |
| 4,147,284 | 4/1979 | Mizzi | 222/401 |
| 4,202,470 | 5/1980 | Fujii | 222/386.5 X |
| 4,222,500 | 9/1980 | Capra et al. | 222/207 |
| 4,392,578 | 7/1983 | Fipp et al. | 222/401 X |
| 4,763,818 | 8/1988 | Stefano et al. | 222/401 X |

FOREIGN PATENT DOCUMENTS

| | | | |
|---|---|---|---|
| 2183737 | 6/1987 | United Kingdom | 222/401 |

*Primary Examiner*—Andres Kashnikow
*Assistant Examiner*—Kenneth DeRosa
*Attorney, Agent, or Firm*—Kelly & Hulme

[57] ABSTRACT

A manually operated continuous aerosol sprayer which eliminates the need for the use of potentially environmentally dangerous substances. A container is provided to hold a liquid and an inflatable bladder is located inside the liquid container. A pump is provided for filling the bladder with air from the outside atmosphere. The open end of the inflatable bladder is attached to the pump so that it may be readily filled by the pump with the remainder of the inflatable bladder extending into the liquid container. When the bladder is inflated it expands causing the liquid in the container to become pressurized. The pressure from the inflation of the bladder causes the air and the liquid to be forced into a spray chamber where they mix and are forced out a spray nozzle as an aerosol spray.

7 Claims, 1 Drawing Sheet

MANUALLY OPERATED AEROSOL SPRAYER

FIELD OF THE INVENTION

The present invention relates to a mechanically pressurized continuous aerosol sprayer which provides a steady atomized spray. The device utilizes a pump to inflate in inflatable bladder which extends into a container of liquid or semi-liquid. The pressure caused by the inflation of the inflatable bladder forces both the liquid or semi-liquid and air from the inflatable bladder into a small spray chamber from which they are ejected as an aerosol spray without the use of chemicals which are damaging to the environment. The use of the inflatable bladder also provides for a more even mixture of the liquid and the air and for a steadier stream of spray when the device is being continuously discharged while being pumped. Also provided for is a means for simultaneously operating valves controlling the flow of liquid and air.

BACKGROUND OF THE INVENTION

This invention relates generally to hand held manual aerosol sprayers. Previous sprayers in the art have failed to provide for a steady flow and for proper mixing of air and product. Many of these earlier sprayers operated improperly if overfilled with the liquid product or if tilted. Some of the earlier sprays also did not remain pressurized between sprays and/or needed to intake air once the spraying was stopped.

An example of an earlier sprayer is disclosed in U.S. Pat. No. 4,024,992, issued May 24, 1977 to Hans G. Schmid (the present inventor), which discloses a sprayer with a flexible body designed to spray a liquid-/air mixture when squeezed. Such a device is not capable of continuous steady stream spraying because of its need to intake air between squeezes.

OBJECTS OF THE INVENTION

An object of the invention is to provide a improved manually operated continuous aerosol sprayer utilizing an inflatable bladder for providing equal liquid and air pressures for the liquid and air to be mixed to form the aerosol spray. The inflatable bladder is positioned within the liquid container so that when the inflatable bladder is inflated the pressure on both the air and the liquid is equal.

A further object of the invention is to provide an improved manually operated aerosol sprayer wherein the stream of aerosol spray will remain substantially steady even when the device is being manually pumped while spraying.

Still a further object of the present invention is to provide a manually operated aerosol sprayer whose performance is not effected by tilting of the device or by the amount of the liquid remaining in the device because the inflatable balloon prevents the forming of any air pockets in the liquid container.

Yet another object of the present invention is to provide means for maintaining the pressure in the device between spraying operations so that none of the prior manual pressurizing effort is wasted.

A further object of the present invention is to provide a manually operated aerosol sprayer which is easily refillable by virtue of a detachable liquid container.

A still further object of the present invention is to provide a simultaneous valve means so that the air and liquid valves are simultaneously operated and neither air nor liquid is sprayed without the other.

Yet another object of the invention is to provide a valve means that is separate from the pump pressurizing means so that the quantity of spray may be exactly controlled.

Still further and other objects will become apparent from the following description, accompanying drawings and claims.

SUMMARY OF THE INVENTION

The present invention provides for a manually operated continuous aerosol sprayer which eliminates the need for the use of potentially environmentally dangerous substances. A container is provided to hold a liquid and an inflatable bladder is located inside the liquid container. A pump is provided for filling the bladder with air from the outside atmosphere. The open end of the inflatable bladder is attached to the pump so that it may be readily filled by the pump with the remainder of the inflatable bladder extending into the liquid container. When the bladder is inflated it expands causing the liquid in the container to become pressurized. The pressure from the inflation of the bladder causes the air and the liquid to be forced into a spray chamber where they mix and are forced out a spray nozzle as an aerosol spray.

In another embodiment of the invention the manually operated continuous aerosol sprayer is comprised of a liquid container for holding a liquid or semi-liquid product which has a threaded neck. A pumping chamber is provided which has a threaded bottom for interconnection with the threaded neck of the container. An inflatable bladder is provided which extends from a portion of the bottom of the pumping chamber downwards into the liquid container. Inside the pumping chamber there is provided a pump which is connected to and capable of inflating the inflatable bladder, and an air portal in the side of the pumping chamber facilitates the filling of the inflatable bladder with outside air. A first tube is provided which extends from near the bottom of the liquid container up through the pumping chamber and into a spray chamber. A second tube is provided which extends from the inflatable bladder to the spray chamber. The bottom of the pumping chamber is so formed so that it has no openings other than where the first and second tubes pass through it and where the pump communicates with part of the opening of the inflatable bladder.

When a pump lever mounted to the side of the pump chamber is operated the pump is caused to fill the inflatable bladder with air, thereby pressurizing both the liquid in the liquid container and the air inside of the inflatable bladder equally. This pressure causes the liquid to move up the first tube and into the spray chamber and causes the air to flow from the inflatable bladder through the second tube and into the spray chamber. Inside the spray chamber the air and liquid streams are mixed and forced out of a nozzle in the side of the spray chamber.

In yet another embodiment of the invention a first valve means is provided on the first tube for regulating the flow of liquid through the first tube and a second valve is provided on the second tube for regulating the flow of air through the second tube. A valve control lever is mounted to the outside of the pumping chamber and is capable of simultaneously opening both the first and second valve means at the same time and simultaneously closing both the first and second valve means at the same time. In this manner the operation of the sprayer may be instantly stopped and air and liquid are prevented from flowing independantly of one another.

DESCRIPTION OF THE PREFERRED EMBODIMENT

Figure 1:
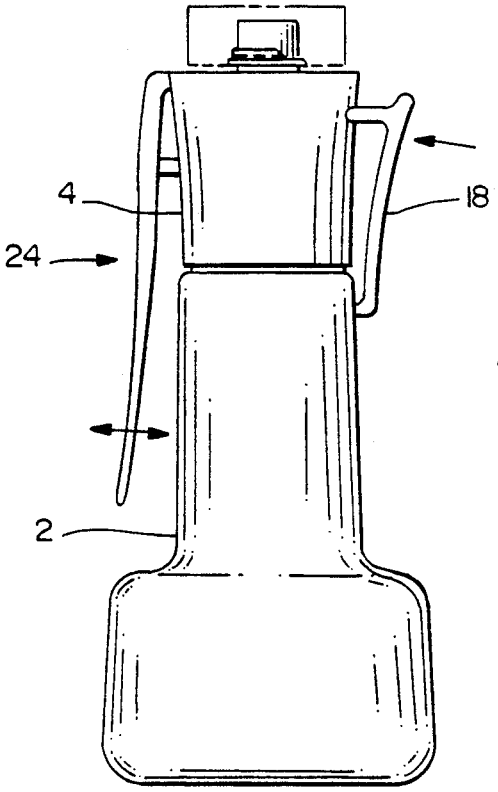
FIG. 1 is a side view of the exterior of one embodiment of the present invention.
Figure 2:
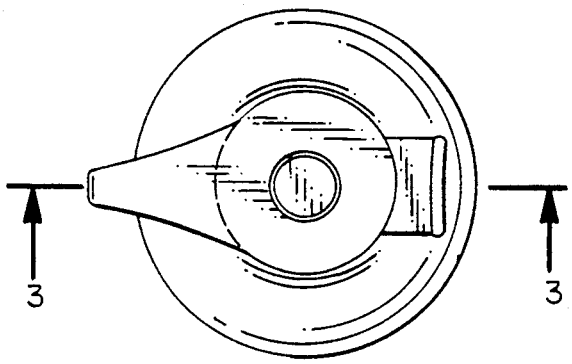
FIG. 2 is a top view of the exterior of the present invention.
Figure 3:
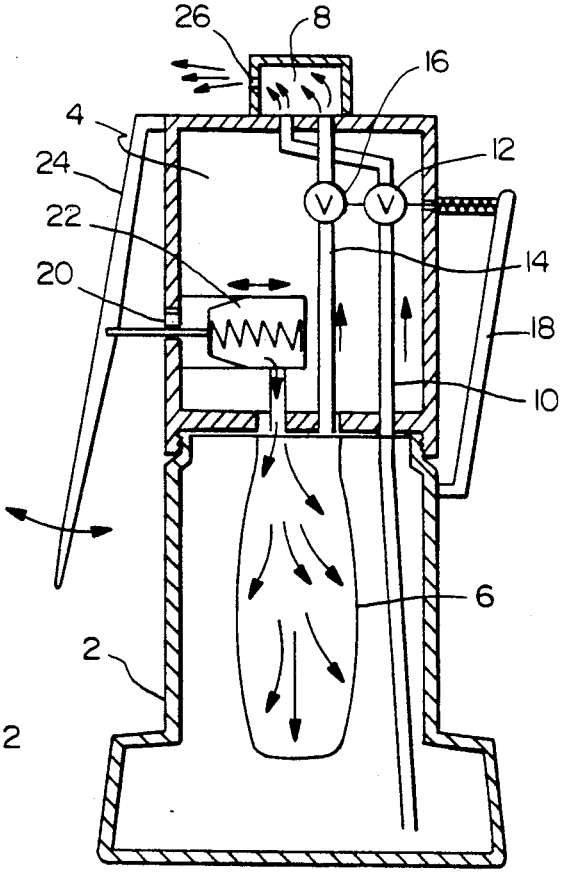
FIG. 3 is a vertical sectional view taken on line 3—3 of FIG. 2.
Figure 4:
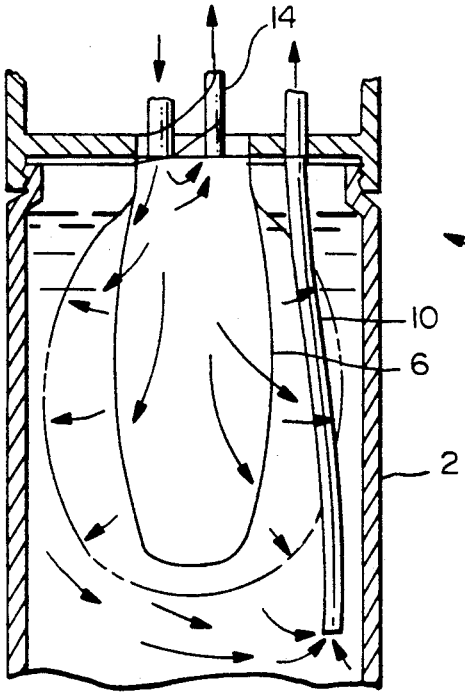
FIG. 4 is a partial vertical sectional view taken on line 3—3 of FIG. 2, showing the flow of air and liquid, into and out of the inflatable bladder and the liquid container, and the expansion of the inflatable bladder.

A preferred embodiment of the invention described with reference to the figures provides for a mechanically pressurized continuous steady stream aerosol sprayer 1 comprising a liquid container 2 having a threaded neck. A pumping chamber 4 is provided having a threaded bottom and so designed so as to be easily attachable and detachable from the liquid container 2.

An inflatable bladder 6 extends from an opening in the bottom of the pumping chamber 4 and substantially into the liquid container 2. An air portal 20 is provided in a side of the pumping chamber 4 so that air from the outside atmosphere may flow readily therethrough to a pump 22 which is located inside the pumping chamber 4 and is manually operated by a pump lever 24 mounted on the side of the pumping chamber 4. The pump 22 is connected through an opening in the bottom of the pumping chamber 4 to the inflatable bladder 6 for inflation thereof.

A first tube 10 extends from substantially the bottom of the liquid container 2 through the pumping chamber 4 and to a spray chamber 8. A second tube 14 is provided which extends from the opening of the inflatable bladder 6 through the pumping chamber 4 and to the spray chamber 8.

A first valve means 12 is provided on the first tube 10 for controlling the flow of liquid or semi-liquid therethrough. A second valve means 16 is provided on the second tube 14 for controlling the flow of air therethrough. A valve control lever 18 is provided on a side of the pumping chamber 4 for simultaneously opening both the valve means 12 and the second valve means 16 and for simultaneously closing both the first valve means 12 and the second valve means 16.

A spray nozzle 26 is provided in the wall of the spray chamber 8 so that an aerosol mixture of the liquid or semi-liquid and the air formed in spray chamber 8 may be ejected through spray nozzle 6.

When the pump lever 24 is manually operated it causes the pump 22 to inflate the inflatable bladder 6 thereby causing an equal build-up of pressure inside both the inflatable bladder 6 and the liquid container 2. With this pressure when the valve control lever 18 has caused the first valve means 12 and the second valve means 16 to be in the open position then the liquid and air flow, through the first tube 10 and the second tube 14 respectively, to the spray chamber 8 where they mix to form an aerosol spray and are ejected out the spray nozzle 26.

When the valve control lever 18 has caused the first valve means 12 and the second valve means 16 to be in the off position then neither the air or the liquid will flow to the spray chamber and all spraying will be abruptly stopped. The use of the valve layer 18 therefore allows a regulable quantity of aerosol spray to be emitted and to be promptly stopped when desired without the necessity to allow the spraying to continue until the pressure has subsided. It also allows any pressure built up within the device to be saved so that the effort of pressurizing the inflatable bladder 6 and the liquid container 2 does not need to be repeated or duplicated.

The first tube 10 and the second tube 14, as well as the first valve means 12 and the second valve means 16, may be so sized as to restrict the flow of liquid and air to some finite maximum amount. In this manner the device may be pressurized while the valve control lever 18 is in the off position to a pressure which exceeds the amount necessary to cause the maximum flow through the first tube 10 and the second tube 14 as regulated by both the tubes and the valve means. At this pressure when the valve control lever 18 is moved to the open or on position the flow of liquid and air through the tubes and valve means will remain constant and steady at the maximum flow level until the pressure decreases below the minimum threshold pressure required to cause maximum flow. Of course when the pressure is above the minimum threshold pressure required to cause maximum flow the pump lever 24 may be utilized to maintain the pressure above said minimum threshold pressure to prevent the pressure from falling so far as to cause a non-steady flow.

The use of the inflatable bladder 6 also prevents the formation of air pockets within the liquid container 2 (other than the air pocket inside the air pocket inside the inflatable bladder) so that no air is ever forced through the first tube 10.

It should be noted that the bottom of the pumping chamber 4 is closed except for where the first tube 10 and the second tube 14 pass therethrough and for the connection between the pump 22 and the inflatable bladder 6.

The equal pressure built up within the inflatable bladder 6 and the liquid container 2 cause liquid and air to flow through the first tube 10 and the second tube 14 at even pressures so that they are uniformly mixed within the spray chamber 8 in the proper ratio so that a properly balanced spray is emitted through spray nozzle 26.

It should also be note that this device is obviously not capable of being impeded in its operation by reason of over filling because of the separation of the liquid or semi-liquid and the air prior to the spray chamber 8.

What is claimed is:

1. A mechanically pressurized continuous aerosol sprayer comprising:

a liquid container for holding a liquid;

an inflatable bladder located inside the liquid container for forcing the liquid out of the liquid container;

a pump means for filling the inflatable bladder with air;

a spray nozzle;

a spray chamber;

a delivery means for delivering the air from said inflatable bladder to said spray chamber and for delivering the liquid which is forced out of said liquid container to said spray chamber; and wherein the liquid from the liquid container and the air from the inflatable bladder is mixed in said spray chamber and the mixture of air and liquid is allowed to be sprayed out of the spray nozzle.

2. The device of claim 1, wherein said delivery means comprises:

a first tube means extending from an area near the bottom of the liquid container to the spray chamber;

a first valve means for controlling the flow of liquid through the first tube;

a second tube means extending from the inflatable bladder to the spray chamber; and a second valve means for controlling the flow of air through the second tube means.

3. The device of claim 2, further comprising:

a valve control lever capable of simultaneously opening both the first valve means and the second valve means at the same time and of closing both the first valve means and second valve means at the same time.

4. The device of claim 3, further comprising a pump lever for manually operating the pump.

5. The device of claim 4, wherein the pump and the first and second valve means are located inside a pumping chamber upon which the valve control lever and the pump lever are mounted and through which the first tube means and the second tube means pass and to which is connected the inflatable bladder and which has an air portale for communicating the pump with the outside atmosphere.

6. The device of claim 5, wherein the pump chamber is detachably mounted to the liquid container.

7. A manually operated continuous aerosol sprayer comprising:

a liquid container for holding a liquid or semi-liquid product having a threaded neck;

a pumping chamber having a threaded bottom for interconnection with the threaded neck of the container;

an inflatable bladder extending downwards from the bottom of the pumping chamber into the liquid container;

a spray chamber with a spray nozzle;

a first tube connected between the spray chamber and the liquid container and extending to substantially near the bottom of the liquid container;

a first valve means for controlling the flow of liquid through the first tube from the liquid container to the spray chamber;

a second tube connected between the spray chamber and the inflatable bladder;

a second valve means for controlling the flow of air through the second tube from the inflatable bladder to the spray chamber;

a valve control lever for opening both the first valve means and the second valve means at the same time and closing both the first valve means and the second valve means at the same time;

an air portal located in a wall of the pumping chamber through which air can pass;

a pump connected between the air portal and the inflatable bladder;

a pump lever for operating the pump so as to cause an equivalent pressure build up in the inflatable bladder and the liquid container so that when the first and second valve means are opened liquid and air will flow into the spray chamber where it will mix and spray out of the spray nozzle.

* * * * *